US007640971B2

(12) United States Patent
Kolb

(10) Patent No.: US 7,640,971 B2
(45) Date of Patent: Jan. 5, 2010

(54) HEAT EXCHANGER MANIFOLD SEALING SYSTEM

(75) Inventor: John A. Kolb, Old Lyme, CT (US)

(73) Assignee: Centrum Equitites Acquisition, Nashville, TN (US)

( * ) Notice: Subject to any disclaimer, the term of this patent is extended or adjusted under 35 U.S.C. 154(b) by 219 days.

(21) Appl. No.: 11/761,691

(22) Filed: Jun. 12, 2007

(65) Prior Publication Data

US 2008/0308263 A1 Dec. 18, 2008

(51) Int. Cl.
*F28F 9/02* (2006.01)

(52) U.S. Cl. ..... 165/149; 29/890.052; 165/906

(58) Field of Classification Search ..... 165/149
See application file for complete search history.

(56) References Cited

U.S. PATENT DOCUMENTS

| | | | | | |
|---|---|---|---|---|---|
| 4,331,201 | A | | 5/1982 | Hesse | |
| 4,351,390 | A | * | 9/1982 | Argyle et al. | 165/149 |
| 4,378,174 | A | | 3/1983 | Hesse | |
| 4,544,029 | A | * | 10/1985 | Cadars | 165/149 |
| 4,546,822 | A | | 10/1985 | Tamura | |
| 4,649,628 | A | * | 3/1987 | Allemandou | 165/148 |
| 4,917,182 | A | * | 4/1990 | Beamer | 165/173 |
| 4,997,035 | A | * | 3/1991 | Beatenbough et al. | 165/173 |
| 5,195,582 | A | | 3/1993 | Haase | |
| 5,201,368 | A | * | 4/1993 | Kroetsch | 165/173 |
| 6,082,446 | A | * | 7/2000 | Ahaus et al. | 165/173 |
| 2002/0029874 | A1 | | 3/2002 | Boisselle et al. | |
| 2002/0144805 | A1 | | 10/2002 | Kim et al. | |
| 2005/0039894 | A1 | * | 2/2005 | Brost et al. | 165/149 |
| 2005/0133208 | A1 | * | 6/2005 | Powers et al. | 165/149 |
| 2006/0137866 | A1 | * | 6/2006 | Hernandez et al. | 165/149 |

FOREIGN PATENT DOCUMENTS

| | | | |
|---|---|---|---|
| EP | 54815 | A1 * | 6/1982 |
| EP | 0406774 | | 1/1991 |
| GB | 1433023 | | 4/1976 |

* cited by examiner

*Primary Examiner*—Allen J Flanigan
(74) *Attorney, Agent, or Firm*—DeLio & Peterson, LLC; Peter W. Peterson

(57) ABSTRACT

A heat exchanger manifold with improved sealing between the tank and header. The manifold includes a plastic heat exchanger tank having an opening for mating with a header and a lip extending substantially around a periphery of the opening. The lip has an outer surface and an upper surface extending outward of the tank opening, and a ridge extending upward from a portion of the upper surface extending substantially around the tank. The manifold further includes an aluminum heat exchanger header adapted to connect to a heat exchanger core. The header has a groove around the periphery thereof receiving the tank lip and a plurality of plastically deformable tabs extending from an edge of the groove. The tabs are bent inward and contact the ridge on the tank lip to secure the tank to the header.

10 Claims, 6 Drawing Sheets

HEAT EXCHANGER MANIFOLD SEALING SYSTEM

BACKGROUND OF THE INVENTION

1. Field of the Invention

The present invention relates to heat exchangers and, in particular, to radiators employed with internal combustion engines used in motor vehicles.

2. Description of Related Art

It has become common practice to use plastic tanks, usually made of glass-reinforced nylon 6/6 material, on heat exchangers with headered cores of brazed aluminum construction. Such heat exchangers include engine-cooling radiators, heaters and some intercoolers, primarily for automobile use. This plastic tank/aluminum (PTA) heat exchanger construction technique is also being used in some heavy-duty truck radiator applications. The problem with typical PTA construction is that it has always been considered inferior to more robust construction methods, such as tanks with gasketed, bolted tank-to-header joints, or soldered or welded tank-to-header joints. Such a judgment stems from the fact that the foot of a plastic tank is typically secured to a shallow groove in the aluminum header by means of bending tabs, which are part of the header, over the tank foot, with a rubber gasket seal between the tank foot and the bottom of the groove. When pressure is applied to the inside of the tank during operation, the tank foot tends to move upwards in a direction that tends to unbend the tabs. With repeated cycles of pressure, the tabs weaken, the compression on the gasket is relieved, and leakage of coolant to the outside occurs.

Other weaknesses of typical PTA construction include flexing of the plastic tank under cyclic pressure and temperature conditions, contributing to movement of the tank foot within the header groove, resulting in leakage. In addition, the header tab material is rendered soft by the core brazing process, making it prone to unbending during operation, leading to reduced pressure on the gasket and, ultimately, leaking. The gasket material chosen for PTA construction is not always of high quality sufficient to resist aging and stiffening under high temperatures. This is often the cause of leaking in PTA radiators. Such leaking problems are the reason for the poor reputation of PTA heat exchanger construction compared to more traditional construction methods. However, PTA construction readily lends itself to high volume, low cost production. If means could be found to overcome the shortcomings of PTA construction, it would be a welcome improvement.

SUMMARY OF THE INVENTION

Bearing in mind the problems and deficiencies of the prior art, it is therefore an object of the present invention to provide an improved heat exchanger manifold.

It is a further object of the present invention to provide an improved heat exchanger manifold sealing system and method that is particularly useful in plastic tank and aluminum header applications.

It is another object of the present invention to provide an improved heat exchanger manifold sealing system and method that reduces the tendency to unbend tabs used to secure the tank foot during operation and use of the heat exchanger.

It is yet another object of the present invention to provide a heat exchanger manifold sealing system that reduces the tendency of the tank foot to rotate in the header groove during operation.

A further object of the invention is to provide an improved gasket seal and sealing method in a heat exchanger manifold.

Still other objects and advantages of the invention will in part be obvious and will in part be apparent from the specification.

The above and other objects, which will be apparent to those skilled in the art, are achieved in the present invention which is directed to a heat exchanger manifold comprising a heat exchanger tank having an opening for mating with a header and a lip extending substantially around a periphery of the opening. The lip has an outer surface and an upper surface extending outward of the tank opening, and a ridge extending upward from a portion of the upper surface extending substantially around the tank. The manifold further includes a heat exchanger header adapted to connect to a heat exchanger core. The header has a groove around the periphery thereof receiving the tank lip and at least one plastically deformable tab extending from an edge of the groove. The at least one plastically deformable tab is bent inward and contacting the ridge on the tank lip to secure the tank to the header.

Preferably, the at least one plastically deformable header tab is metal, and the metal tab is work hardened near the contact with the ridge on the tank lip. The plastically deformable header tab is preferably free of contact with the lip upper surface inward of the ridge. The tank and tank lip are preferably plastic, and the tank has a semi-circular cross-section opposite the opening. The tank lip has a height and a width, and preferably has a lip depth to width ratio of at least about 1.5:1. The groove has a depth and a width, and preferably has a groove depth to width ratio of at least about 1.5:1. The tank lip width is preferably substantially equal to the groove width to create a sliding fit between the tank lip and the groove walls. More preferably, the tank lip penetrates into the groove at least about 2.05 mm.

More preferably, the manifold further includes an elastomeric gasket in the header groove contacting the tank lip lower surface. The gasket has an elliptical cross section in an undeformed state with a major diameter in the width direction of the groove and a minor diameter in the depth direction of the groove. The gasket is deformed by contact with the tank lip to fill essentially the entire region between the groove and the tank lip lower surface, thereby sealing the tank lip and tank opening to the header.

In another aspect, the present invention is directed to a heat exchanger manifold comprising a heat exchanger tank having an opening for mating with a header and a lip extending substantially around a periphery of the opening. The lip has an outer surface and an inner surface and a lip width therebetween. The manifold also includes a heat exchanger header adapted to connect to a heat exchanger core. The header has a groove formed by opposite walls extending around the periphery thereof, with the groove receiving the tank lip. The groove has a depth and a width between the opposite groove walls, with a depth to width ratio of at least about 1.5:1.

Preferably, the tank lip has an upper surface extending outward of the tank opening and a ridge extending upward from a portion of the upper surface extending substantially around the tank lip, and the header groove has at least one tab extending from an edge of the groove, with the at least one tab being bent inward and contacting the ridge on the tank lip to secure the tank to the header. Preferably the tank lip is plastic and the tank lip width is substantially equal to the header groove width to create a sliding fit between the tank lip and the groove walls.

In a further aspect, the present invention is directed to a method of assembling a heat exchanger manifold comprising providing a heat exchanger tank having an opening for mating with a header and a lip extending substantially around a periphery of the opening, the lip having an outer surface and an upper surface extending outward of the tank opening, and a ridge extending upward from a portion of the upper surface extending substantially around the tank. The method also provides a heat exchanger header adapted to connect to a heat exchanger core, the header having a groove around the periphery thereof for receiving the tank lip and at least one tab extending from an edge of the groove. The method then includes mating the tank to the header so that the tank lip is received in the header groove, and bending an upper portion of the at least one tab inward to contact the ridge on the tank lip to secure the tank to the header.

The method preferably includes using a plurality of header tabs made of metal, and bending the metal tabs using the ridge as a fulcrum to plastically deform the metal tab.

Prior to mating the tank to the header, the method preferably includes placing in the header groove an elastomeric gasket, the gasket having an elliptical cross section in an undeformed state with a major diameter in the width direction of the groove and a minor diameter in the depth direction of the groove. Subsequent to mating the tank to the header, the method preferably includes deforming the gasket by contact with the tank lip to fill essentially the entire region between the groove and the tank lip lower surface and seal the tank opening to the header, thereby sealing the tank lip and tank opening to the header.

Preferably, the tank lip is plastic and the groove is formed by opposite walls extending around the periphery of the header, and the tank lip width is substantially equal to width of the header groove to create a sliding fit between the tank lip and the groove walls.

In yet another aspect, the present invention provides a heat exchanger manifold comprising a heat exchanger tank having an opening for mating with a header and a lip extending substantially around a periphery of the opening, the tank lip having a lower surface, and a heat exchanger header adapted to connect to a heat exchanger core, the header having a groove formed by opposite walls extending around the periphery thereof, the groove having a depth and a width between the opposite walls, the groove receiving the tank lip. The manifold further includes an elastomeric gasket in a region of the header groove below the tank lip lower surface. The gasket has an elliptical cross section in an undeformed state with a major diameter in the width direction of the groove and a minor diameter in the height direction of the groove. The gasket is deformed by contact with the tank lip to fill essentially the entire region between the groove and the tank lip lower surface, thereby sealing the tank lip and tank opening to the header.

In a related aspect, the present invention provides a method of assembling a heat exchanger manifold comprising providing a heat exchanger tank having an opening for mating with a header and a lip extending substantially around a periphery of the opening, the tank lip having a lower surface, and providing a heat exchanger header adapted to connect to a heat exchanger core, the header having a groove formed by opposite walls extending around the periphery thereof, the groove having a depth and a width between the opposite walls, the groove adapted to receive the tank lip. The method includes placing in the header groove an elastomeric gasket, the gasket having an elliptical cross section in an undeformed state with a major diameter in the width direction of the groove and a minor diameter in the depth direction of the groove. The method then includes mating the tank to the header so that the tank lip is received in the header groove and the tank lip lower surface contacts the elastomeric gasket, and deforming the gasket by contact with the tank lip to fill essentially the entire region between the groove and the tank lip lower surface and seal the tank opening to the header, thereby sealing the tank lip and tank opening to the header.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

In describing the preferred embodiments of the present invention, reference will be made herein to FIGS. 1-6 of the drawings in which like numerals refer to like features of the invention.

As used herein, a heat exchanger manifold consists of an inlet or outlet tank for the heat exchanger coolant, a header for attachment to the tubes of a heat exchanger core, and a seal between the tank and header joint. Preferably, the tank is made of an otherwise conventional molded plastic such as glass-reinforced nylon 6/6 material, and the header is made of a metal such as aluminum. Other types of tank and header materials may also be employed. The heat exchanger manifold of the present invention may be used in heavy-duty truck or other motor vehicle heat exchangers, such as in automobile radiators of superior durability, or in other heat exchanger applications where strength, vibration resistance and long life are required.

Figure 1:
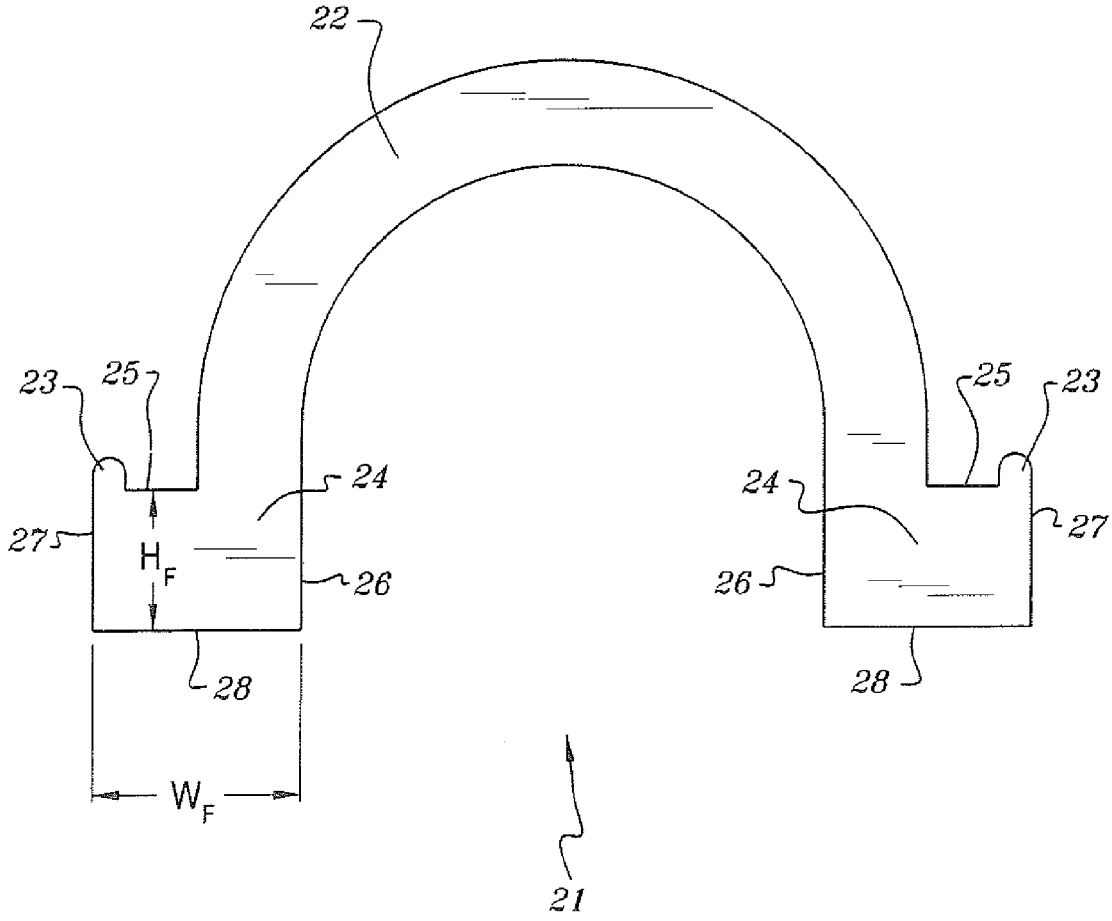
FIG. 1 is a cross sectional elevational view of a preferred tank of the present invention.
Figure 2:
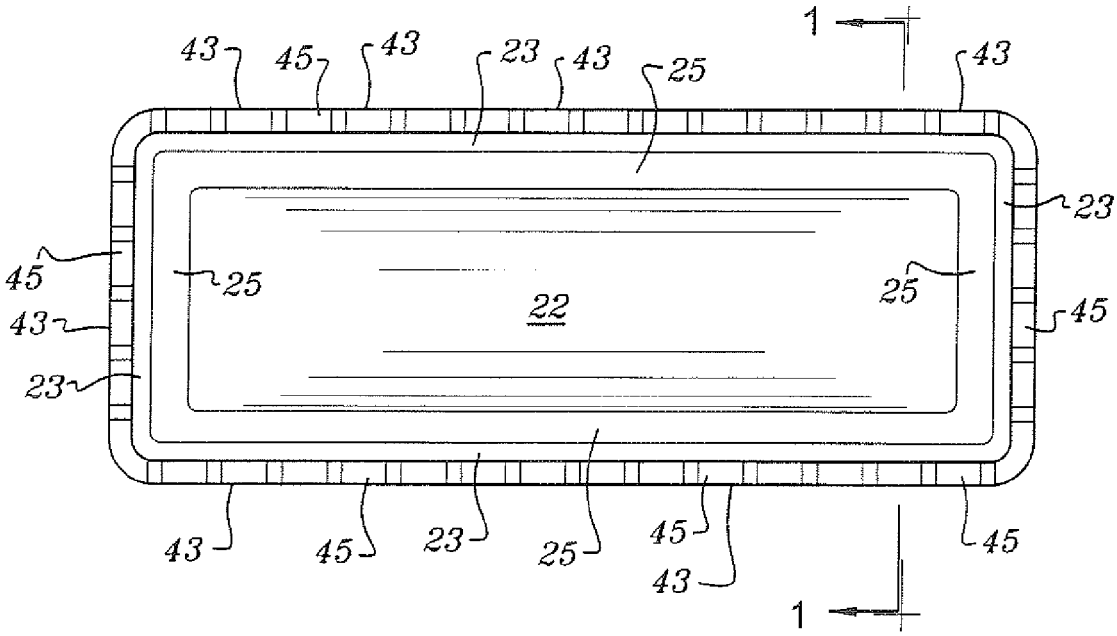
FIG. 2 is a top plan view of the tank of FIG. 1 mated with a header made in accordance with the present invention, prior to crimping of the tabs.

As shown in FIGS. 1 and 2, tank 22 is elongated such that its length (horizontally in FIG. 2) is greater than its width (vertically in FIG. 2). Preferably for truck or other heavy-duty motor vehicle radiator applications, the upper surface has a semicircular configuration as seen in a cross-section normal to the tank length (FIG. 1) and has a wall thickness typically of about 0.155 in. (3.9 mm) for good stiffness to minimize tank flexing. The preferred tank of the present invention achieves sufficient strength and stiffness without the necessity for ribs in the tank upper walls. The tank has an opening 21 on a lower side thereof for mating with the header, and a foot or lip 24 extending outward from the tank opening around substantially the entire periphery of the opening. The foot or lip 24 has opposite inner 26 and outer 27 surfaces, and opposite upper 25 and lower 28 surfaces. The width of the foot or lip 24 is shown as $W_F$. Along the outer portion of upper surface 25, near the outer surface 27, is disposed an upwardly extending ridge 23 that is essentially continuous around the periphery of the tank. Ridge 23 covers only a portion of upper surface 25, 50 that the portion of upper surface 25 adjacent the tank 22 wall is lower than the maximum height of the ridge. The preferred tank foot as shown has a vertical height $H_F$ between upper surface 25 and lower surface 28 that is greater than the foot width $W_F$, and may be at least 1.5 or 2 times the foot width.

Figure 3:
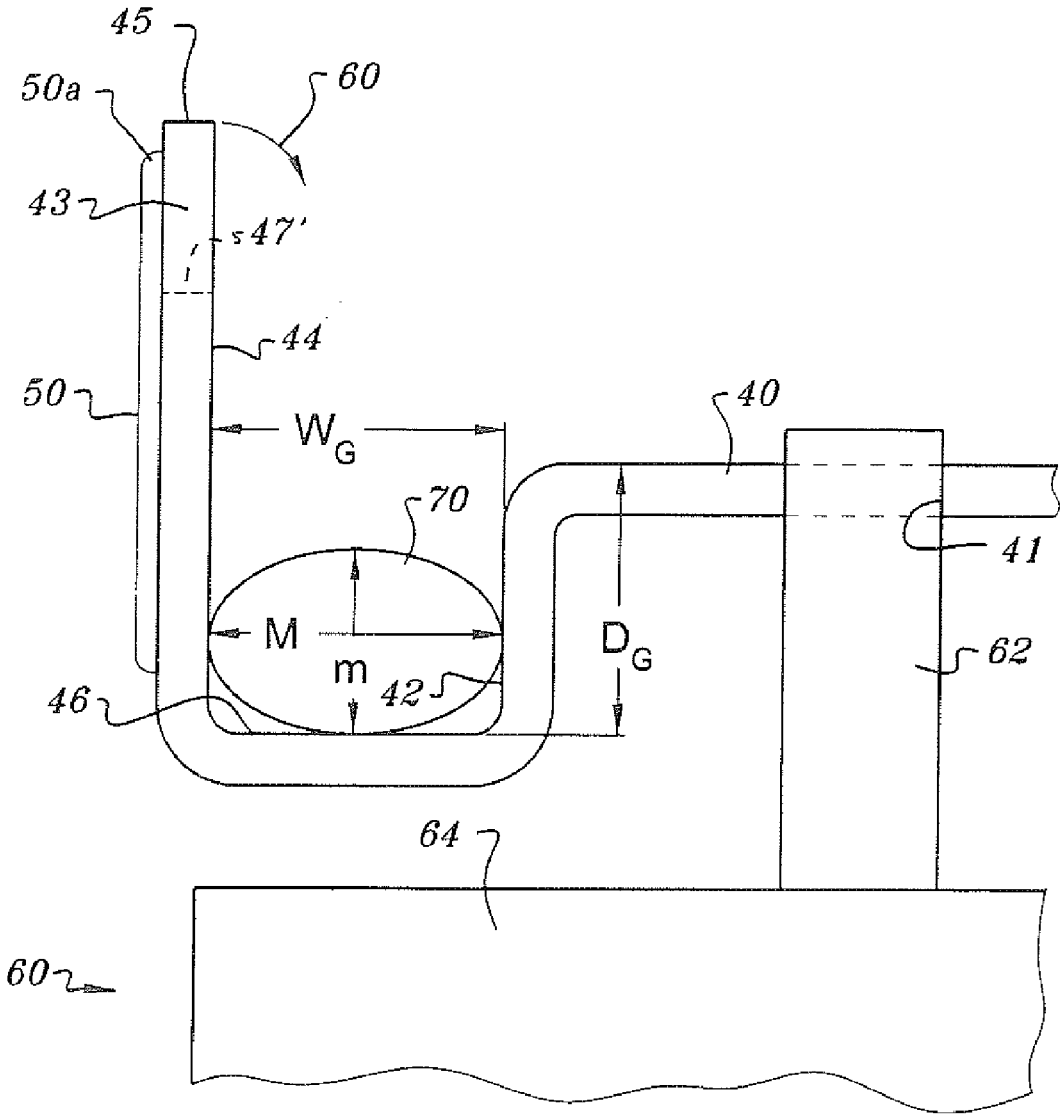
FIG. 3 is a cross sectional elevational view of a portion of the preferred header of the present invention prior to assembly with the tank.
Figure 4:
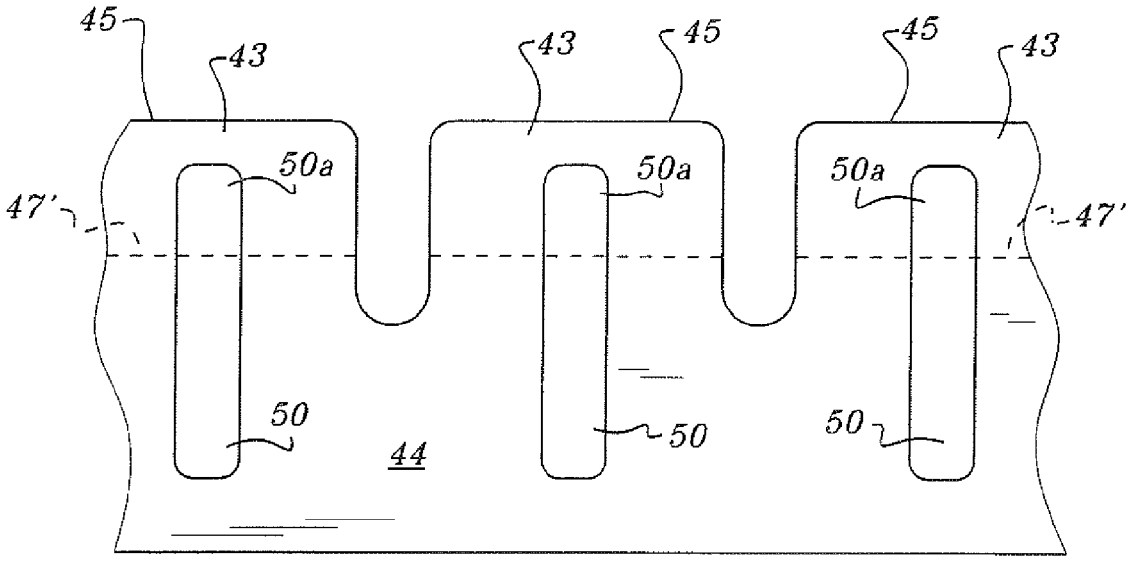
FIG. 4 is a side elevational view of a portion of the header of FIG. 3 showing the ribs on the undeformed tabs.
Figure 5:
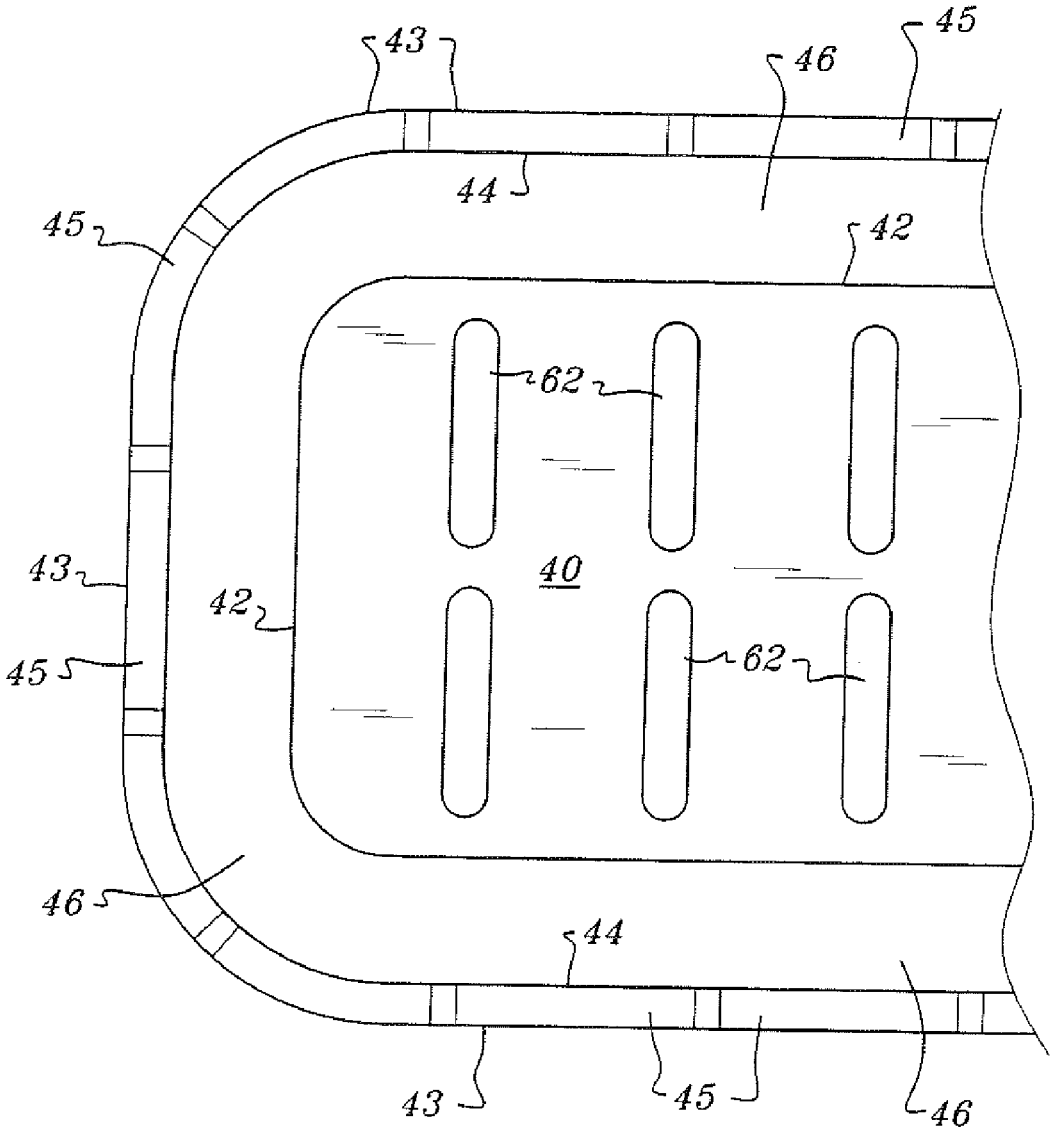
FIG. 5 is a top plan view of an end portion of the header of FIG. 3.

The preferred heat exchanger header of the present invention is shown in FIGS. 3-5. Header 40 includes openings 41 for receiving the ends of tubes 62 of an otherwise conventional heat exchanger core 60. Fins 64 are secured to the tubes to dissipate heat from coolant flowing through the tubes. Although the connection between header 40 and tubes 62 may be any type known in the prior art, the present invention is especially useful where the core tubes 62 are brazed to the header openings 41. A groove extends around the periphery of header 40 for mating with the foot or lip 24 of the tank 22. The groove is formed by inner vertical wall 42, outer vertical wall 44, and lower wall 46 connecting the vertical walls. Outer wall 44 has a plurality of upper portions terminating in end edge 45. As shown in FIGS. 3 and 4, the upper portion of wall 44 comprises a plurality of spaced tabs 43 that will be bent along phantom line 47' inward in the direction of arrow 60 after mating with the tank, as will be explained in more detail below. Each tab 43 is spaced from an adjacent tab by a slot extending below phantom bend line 47', and the tabs extend substantially around the periphery of the header groove. To provide for further tab strength against tab unbending, the preferred heat exchanger header incorporates at last one stiffening rib 50 having an upper portion 50*a* extending into each tab 43, substantially normal or perpendicular to the direction of bend line 47'. The rib may be formed by embossing or otherwise plastically deforming the groove outer wall 44. Ribs may be included on all or fewer than all of the tabs.

The width of the groove is shown in FIG. 3 as dimension $W_G$, the distance between inner and outer walls 42 and 44, respectively. The depth of the groove is shown as dimension $D_G$, the dimension between the top of the header plate 40 and the top of the groove lower surface 46. The header groove is narrow in relation to its depth, preferably being as narrow as possible relative to its depth as manufacturing standards would allow. More preferably, the ratio of depth to width is at least about 1.5:1. In a typical truck or heavy-duty automobile radiator application of the present invention, the groove depth is about 0.300 in. (7.6 mm) and the width is about 0.205 in (5.2 mm).

Disposed in the bottom of the header grove is a continuous ring-type elastomeric gasket 70. To eliminate gasket deterioration under high coolant operating temperatures, the tank-to-header gasket 70 used in the heat exchanger manifold is made of EPDM rubber, preferably in an elliptical cross section. The major diameter M of the gasket elliptical cross-section is disposed in the direction of the width of the groove, and the minor diameter m of the gasket elliptical cross-section is disposed in the direction of the depth of the groove. Because of the general incompressibility of rubber, the seal is designed with an elliptical cross section to insure that the void between the tank foot and the header groove becomes completely filled by the rubber when the gasket is deformed between the tank foot and the groove side and bottom walls during assembly, as will be discussed further below.

Figure 6:
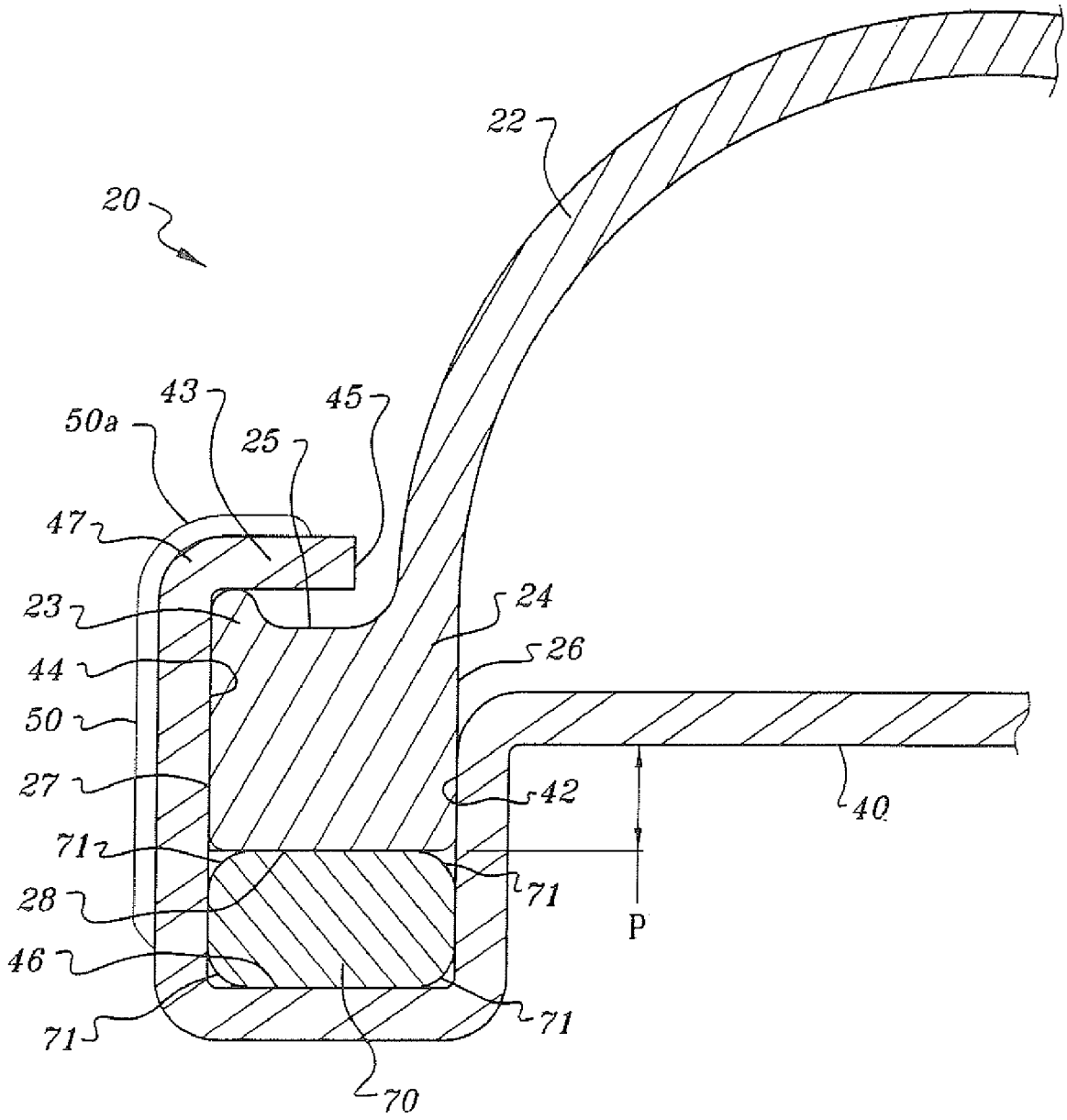
FIG. 6 is a cross sectional elevational view of the tank of FIG. 1 mated and sealed to the header of FIG. 3 in accordance with the present invention.

The mated and assembled heat exchanger manifold 20 is shown in FIG. 6. After placing elliptical elastomeric gasket 70 in the bottom of the header groove, tank foot or lip 24 is received over the gasket so that the lower surface 28 of the foot contacts the upper surface of gasket 70. The width $W_F$ of the foot (FIG. 1) is substantially equal to the width $W_G$ of the header groove (FIG. 3), so that a sliding contact is created between the inner and outer surfaces 26, 27 of the tank foot and the respective inner and outer walls 42, 44 of the header groove. In a typical heavy-duty motor vehicle application, the tank foot preferably has a penetration P (FIG. 6) along the groove inner wall, below the entry radius, of at least about 2.05±0.02 mm. The depth of penetration is sufficient to prevent rotational flexing of the foot within the groove when the tank is under pressure. The narrow header groove accommodates the tank foot, which substantially reduces any tendency of rotation of the tank foot within the header groove.

To secure the header to the tank, the tabs 43 are bent inwards along bend line 47' (FIGS. 3 and 4) so that they contact ridge 23 along the outer portion of foot top surface 25. Ridge 23 provides a fulcrum for the bending of the retaining header tabs 43 during manifold assembly. When tabs 43 are bent, the metal becomes work-hardened in the area 47 of the bend. In operation of the finished heat exchanger manifold, the ridge or fulcrum becomes the point at which unbending stresses are applied to the work-hardened tabs at the very point where they are strongest. Rib portion 50*a* also bends and work hardens, and provides extra strength to the finished structure. In contrast to typical prior tab/tank foot designs, the tabs 43 of the present invention do not have to contact the upper surface 25 of the tank foot except at ridge 23, where the tabs are hardened. The end 45 of the tab inward of ridge 23 sees no deformation or work hardening, and is preferably spaced from and free of contact with the foot upper surface.

As the tabs 43 are crimped over the tank foot, the foot lower surface 28 is forced down against the top of elliptical gasket 70 toward the groove bottom surface 46. These forces cause the elliptical gasket to be deformed so that the gasket fills essentially the entire region between the groove walls 42, 44, 46 and the tank foot lower surface 28. Minor spaces 71 may still be present around corner areas of the gasket after deformation. Sealing stress is created as the rubber pushes out radially against the constraining surfaces of the foot and the header groove. The gasket loading together with the close sliding fit of the tank foot creates a hydraulic lock with the header groove. The gasket material and elliptical shape, together with the close fitting piston-like tank foot that penetrates deep inside the gasket groove, load the incompressible elastomeric gasket material in such a way that minimizes the long term effects of gasket relaxation, squeeze-out, permanent deformation and chemical effects. These have been found to be significant factors that play a major role in the reliability of plastic tank-to-header sealing.

The present invention takes advantage of the work hardening of the metal retaining tabs during bending by directing the unbending stresses, which result from pressurizing the tank, to that portion of the retaining tabs which have been work hardened. This is accomplished by means of ridge 23 on the tank foot upper surface 25. The balance of the upper surface of the tank foot is lower than the ridge in that region of the tabs which may be still soft from the brazing operation used to secure the core tubes to the header openings. This feature, combined with tab stiffening ribs, high-quality EPDM rubber elliptical gasket, deep header grooves, long tank foot and thicker, semi-circular tank cross-section, will result in a PTA heat exchanger construction which will provide a long, leak-free, useful life to rival traditional prior art construction techniques. To provide some measure of useful life, pressure cycle tests have shown that the heat exchanger manifold of the present invention will survive 250,000 cycles of the standard pressure cycle test that is normally applied to typical PTA production radiators. By comparison, the typical requirement for automobile original equipment PTA construction radiators is 150,000 cycles, the typical requirement for large, heavy-duty original equipment bolt-up radiators is 65,000 cycles, and the typical requirement for soldered aftermarket automobile radiators is only 15,000 cycles.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A heat exchanger manifold comprising:

a heat exchanger tank having an inner wall, an opening for mating with a header and a lip extending substantially around a periphery of the opening, the lip having an inner surface extending straight from the tank inner wall, an outer surface and an upper surface extending outward of the tank opening, and a ridge extending upward from a portion of the upper surface extending substantially around the tank, the tank lip having a height and a width, and a lip height to width ratio of at least about 1.5:1; and a heat exchanger header adapted to connect to a heat exchanger core, the header having a groove around the periphery thereof receiving the tank lip, the groove having a depth and a width between opposite groove walls, and a groove depth to width ratio of at least about 1.5:1, the header groove width being substantially equal to the tank lip width to create a sliding fit between the tank lip and the groove walls, and at least one plastically deformable tab extending from an edge of the groove, the at least one plastically deformable tab being bent inward and contacting the ridge on the tank lip to secure the tank to the header, the at least one plastically deformable header tab being free of contact with the lip upper surface inward of the ridge.

2. The heat exchanger manifold of claim 1 wherein the at least one plastically deformable header tab is metal, and wherein the metal tab is work hardened near the contact with the ridge on the tank lip.

3. The heat exchanger manifold of claim 1 wherein the tank lip has a lower surface, and further including an elastomeric gasket in the header groove contacting the tank lip lower surface.

4. The heat exchanger manifold of claim 1 wherein the tank lip penetrates into the groove at least about 2.05 mm.

5. The heat exchanger manifold of claim 1 wherein the tank lip has a flat lower surface, and further including an EPDM rubber gasket in a region of the header groove below the tank lip lower surface, the gasket having an elliptical cross section in an undeformed state with a major diameter in the width direction of the groove and a minor diameter in the depth direction of the groove, the gasket being deformed by contact with the tank lip to fill essentially the entire region between the groove and the tank lip flat lower surface, thereby sealing the tank lip and tank opening to the header.

6. The heat exchanger manifold of claim 1 wherein the tank lip has a width and the groove has a depth and a width, and wherein the tank lip width is substantially equal to the groove width.

7. The heat exchanger manifold of claim 1 wherein the tank is plastic and has a semi-circular cross-section opposite the opening.

8. A method of assembling a heat exchanger manifold comprising:

providing a heat exchanger tank having an inner wall, an opening for mating with a header and a lip extending substantially around a periphery of the opening, the lip having an inner surface extending straight from the tank inner wall, an outer surface and an upper surface extending outward of the tank opening, and a ridge extending upward from a portion of the upper surface extending substantially around the tank, the tank lip having a height and a width, and a lip height to width ratio of at least about 1.5:1;

providing a heat exchanger header adapted to connect to a heat exchanger core, the header having a groove around the periphery thereof for receiving the tank lip, the groove having a depth and a width between opposite groove walls, and a groove depth to width ratio of at least about 1.5:1, the header groove width being substantially equal to the tank up width, and at least one tab extending from an edge of the groove;

mating the tank to the header so that the tank lip is received in the header groove to create a sliding fit between the tank lip and the groove walls; and bending an upper portion of the at least one tab inward to contact the ridge on the tank lip to secure the tank to the header, the tab being free of contact with the lip upper surface inward of the ridge.

9. The method of claim 8 including a plurality of header tabs made of metal, and bending the metal tabs using the ridge as a fulcrum to plastically deform the metal tab.

10. The method of claim 8 wherein the tank lip has a flat lower surface and further including, prior to mating the tank to the header, placing in the header groove an EPDM rubber gasket, the gasket having an elliptical cross section in an undeformed state with a major diameter in the width direction of the groove and a minor diameter in the depth direction of the groove; and, subsequent to mating the tank to the header, deforming the gasket by contact with the tank lip to fill essentially the entire region between the groove and the tank lip flat lower surface and seal the tank opening to the header, thereby sealing the tank lip and tank opening to the header.

* * * * *